US009123498B2

(12) United States Patent
Dabringhausen et al.

(10) Patent No.: US 9,123,498 B2
(45) Date of Patent: Sep. 1, 2015

(54) GROUND CONNECTION TO A LAMP HOUSING

(71) Applicant: KONINKLIJKE PHILIPS N.V., Eindhoven (NL)

(72) Inventors: Lars Dabringhausen, Baesweiler (DE); Juergen Gerhard Mertens, Aachen (DE); Anton Duschl, Hauzenberg (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/396,878

(22) PCT Filed: Apr. 15, 2013

(86) PCT No.: PCT/IB2013/052974

§ 371 (c)(1),
(2) Date: Oct. 24, 2014

(87) PCT Pub. No.: WO2013/160797

PCT Pub. Date: Oct. 31, 2013

(65) Prior Publication Data

US 2015/0108893 A1 Apr. 23, 2015

Related U.S. Application Data

(60) Provisional application No. 61/638,582, filed on Apr. 26, 2012.

(51) Int. Cl.

| | |
|---|---|
| ***H01J 5/48*** | (2006.01) |
| ***H01J 5/50*** | (2006.01) |
| ***H01J 5/54*** | (2006.01) |

(52) U.S. Cl.
CPC ..... *H01J 5/54* (2013.01)

(58) Field of Classification Search
CPC ..... H01J 5/50; H01J 5/00; H01J 5/46; H01J 5/54
USPC ..... 313/318.01, 318.05, 318.06, 318.12
See application file for complete search history.

(56) References Cited

U.S. PATENT DOCUMENTS

| | | | | |
|---|---|---|---|---|
| 5,659,221 | A * | 8/1997 | Coushaine et al. | 313/493 |
| 6,364,515 | B1 * | 4/2002 | Daub et al. | 362/548 |
| 8,624,493 | B2 * | 1/2014 | Asmussen et al. | 313/635 |
| 2006/0119282 | A1 | 6/2006 | Hackenbuchner et al. | |
| 2007/0081345 | A1 * | 4/2007 | Wilcox et al. | 362/382 |

(Continued)

FOREIGN PATENT DOCUMENTS

| | | | |
|---|---|---|---|
| DE | 19509112 | A1 | 9/1996 |
| DE | 102011080061 | A1 | 2/2012 |

(Continued)

*Primary Examiner* — Thomas A Hollweg
*Assistant Examiner* — Kevin Quarterman
(74) *Attorney, Agent, or Firm* — Yuliya Mathis

(57) ABSTRACT

A lamp (10) is described comprising a burner (14) fixed to a lamp base (12). The lamp base (12) comprises a metal housing part (40). The metal housing part (40) comprises a contact sheet element (82) made out of a different metal material. Electrical contacts are provided within the base (12), including an electrical ground contact (70). A contact spring (76) is provided for contacting the electrical ground contact (70) to the metal housing part (40). The contact spring (76) is arranged to press against the contact sheet element (82) to provide electrical ground connection to the metal housing part (40).

11 Claims, 5 Drawing Sheets

(56) References Cited

U.S. PATENT DOCUMENTS

| | | | | |
|---|---|---|---|---|
| 2008/0309240 | A1* | 12/2008 | Goray et al. | 315/56 |
| 2010/0134010 | A1* | 6/2010 | Asmussen et al. | 315/51 |

FOREIGN PATENT DOCUMENTS

| | | | |
|---|---|---|---|
| EP | 0923105 | A1 | 6/1999 |
| EP | 1098350 | A1 | 5/2001 |
| EP | 1246512 | A2 | 10/2002 |
| EP | 1602879 | A2 | 12/2005 |
| JP | 2005101011 | A | 4/2005 |
| JP | 2006185625 | A | 7/2006 |
| JP | 2011159544 | A | 8/2011 |
| WO | 9520238 | A1 | 7/1995 |
| WO | 2013160784 | A1 | 10/2013 |

* cited by examiner

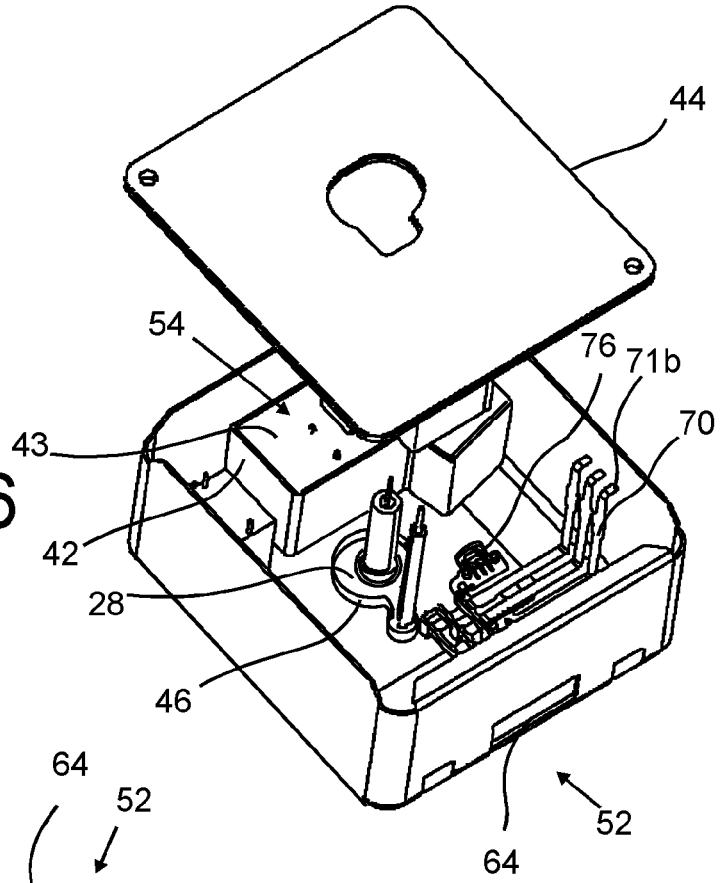
FIG. 6
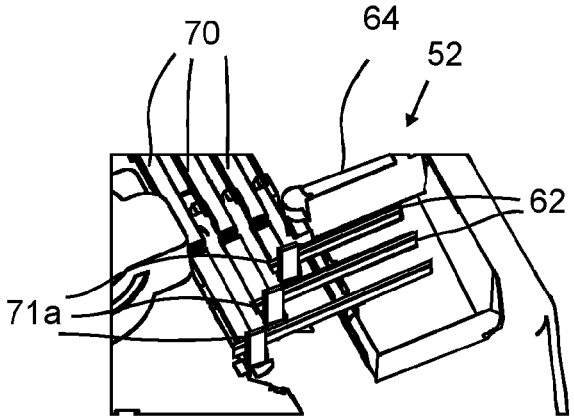
FIG. 7
FIG. 9
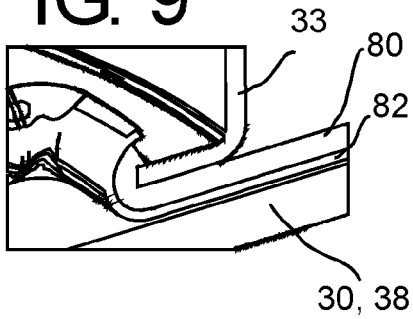
FIG. 8
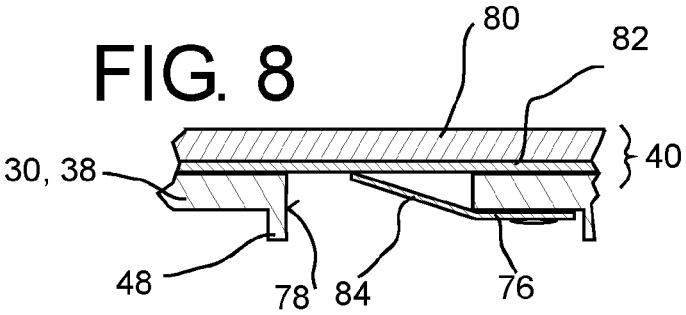

GROUND CONNECTION TO A LAMP HOUSING

CROSS-REFERENCE TO PRIOR APPLICATIONS

This application is the U.S. National Phase application under 35 U.S.C. §371 of International Application No. PCT/IB2013/052974, filed on Apr. 15, 2013, which claims the benefit of U.S. Provisional Patent Application No. 61/638,582, filed on Apr. 26, 2012. This application is hereby incorporated by reference herein.

TECHNICAL FIELD

The present invention relates to the field of lamps, and more specifically to a lamp comprising a burner fixed to a lamp base. In particular, the present invention relates to lamps for use in a vehicle headlight, where the burner comprises a discharge vessel to generate light from an electrical arc discharge generated between electrodes.

BACKGROUND OF THE INVENTION

In electrical lamps, particularly in high intensity discharge (HID) lamps, reliable connection of housing parts to electrical mass or ground is desirable, both for security reasons and for reduction of electromagnetic interference (EMI). This especially applies for discharge lamps, where the lamp base comprises at least a part of the operating electronics, i.e. a driver circuit for operation of the burner and/or starting apparatus for igniting the arc discharge.

US 2006/0119282 A1 describes a high-pressure discharge lamp having a lamp base with an integrated starting apparatus. An electromagnetic shield is provided, which is connected to the ground reference potential of an operating device. The electromagnetic shield is provided as a metal housing which surrounds the lamp base, and has an aperture for a discharge vessel and for electrical connection of the lamp. The metal housing is made from aluminum or from an aluminum/magnesium alloy, or from a galvanized steel sheet. Inside, a lead frame is provided with electrical components of the starting apparatus, which comprises metallic webs embedded in electrically insulating plastic. A metallic tongue protrudes from the lead frame and out of the interior of the lamp base. In the mounted state, the metallic tongue of the metal web is in electrical and mechanical contact with a wall part of the metal housing. The metallic web, in a similar manner to a leaf spring, bears against the metal housing with a clamping fit.

SUMMARY OF THE INVENTION

It is an object of the present invention to provide a lamp with a reliable ground connection to a housing part, which is simple to manufacture.

This object is solved by a lamp according to claim 1. Dependent claims refer to preferred embodiments of the invention.

The lamp according to the invention comprises a burner, preferably a HID burner, fixed to a lamp base. The lamp base comprises at least a metal housing part. Preferably, the lamp base comprises a metal housing at least partly surrounding the lamp base to the sides. Further preferred, the lamp base is fully enclosed in a metal housing, except for an opening to the burner and for an electrical plug/socket connection.

Within the base, electrical contacts are provided, which may be part of operating circuitry or the burner. One of the electrical contacts is an electrical ground contact.

According to the invention, the electrical ground contact is electrically connected to the metal housing part by a contact spring. However, the metal housing part comprises a contact sheet element made out of a different metal material, and the contact spring is arranged to press against the contact sheet to provide an electrical ground connection to the metal housing part.

Thus, the electrical connection of the electrical ground contact within the housing to the metal housing part is established via the contact spring and the contact sheet element.

This construction according to the invention allows to choose the different parts of the metal housing part and of the contact sheet element differently according to their purpose, e.g. with respect to the metal material and thickness thereof. The contact sheet element may be chosen in order to achieve high contact reliability and low contact resistance. Suitable materials include e.g. steel, copper or other metal materials with good contact properties. Preferably the contact sheet may be a thin (e.g. 0.1-0.4 mm thickness) sheet of steel.

The metal housing part, on the other hand serves for stability and for heat conduction and/or radiation. For example, an aluminum material may be preferred. Oxidation on an aluminum material, which may lead to adverse contact properties, is not a problem, because the electrical contact is established via the contact sheet element.

By virtue of the present invention, it is possible to provide a metal housing suitable for the lamp base, while at the same time electrical contact is reliably provided through the contact sheet element.

According to preferred embodiments of the invention, the contact sheet element and the metal housing part are provided as flat metal materials with their surfaces on top of each other. This allows a close connection of the contact sheet element and the metal housing part, ensuring reliable contact. Preferably, the metal housing part has a greater thickness than the contact sheet element.

It is preferred to connect the contact sheet element and the metal housing part by a deformation of both elements, thereby mechanically locking the contact sheet and the metal housing part. For example, the two elements may be connected by a crimping or riveting connection. This type of connection may easily be made during manufacturing, ensuring a both mechanically and electrically reliable connection.

According to a further preferred embodiment of the invention, a holding element for the burner is provided on a top surface of the lamp base. The metal housing part is provided at least at the top surface of the base, oriented towards the burner. The burner holding element, preferably a burner holding ring, may serve to mechanically hold the burner and/or to mechanically fix the lamp to a reflector, e.g. via a bayonet connection. The burner holding element is preferably fixed to the top surface by a deformation of the metal housing part and of the contact sheet element. Thus, by one and the same deformation, which may be e.g. crimping, riveting, bending, etc, the purposes of fixing the burner holding element and of connecting the contact sheet element to the metal housing part are served.

According to a preferred embodiment of the invention, there is a non-conductive holder element disposed within the housing, and the contact spring is fixed to the holder element. Preferably, the electrically insulating holder element is made out of plastic material and disposed within a metal housing. The holder element preferably serves to hold components of the operating circuit for the burner, such as e.g. contact leads of a leadframe and components of a driver circuit and/or ignitor. It is further preferred that the holder element forms an enclosure of a plug/socket connection accessible from the outside to provide an electrical connection of the lamp to an external power supply, such as the onboard electrical supply of a motor vehicle.

Preferably, the non-conductive holder element comprises an opening, and the contact spring extends through the opening to contact the metal housing part via the contact sheet element. This allows to easily fix contact leads and/or electrical components to the holder at an insulation distance from the metal housing.

It is preferred that the lamp base comprises an electrical plug/socket connector with multiple electrical contacts, one of which is an electrical ground/mass contact, electrically connected to the contact spring. The connector further preferably comprises a supply voltage contact and may include a further contact for transmission of control signals.

The contact spring is preferably made from a flat spring material, such as e.g. brass material with nickel plating, or steel. It preferably comprises at least one spring tongue pressing against the contact sheet. Further preferred is to provide multiple elements, such as at least two spring tongues, to improve electrical contact also under adverse mechanical conditions.

BRIEF DESCRIPTION OF THE DRAWINGS

These and other aspects of the invention will be apparent from and elucidated with reference to the embodiments hereinafter.

In the drawings,

FIG. 6 shows a perspective exploded view of parts of the lamp of FIG. 1-5;

FIG. 7 shows a perspective view of parts of the lamp of FIG. 1-6;

FIG. 8 shows a partial sectional view of the lamp of FIG. 1-7;

FIG. 9 shows a sectional perspective view of parts of the lamp of FIG. 1-8 with the section along A . . . A in FIG. 1;

DESCRIPTION OF EMBODIMENTS

Figure 1:
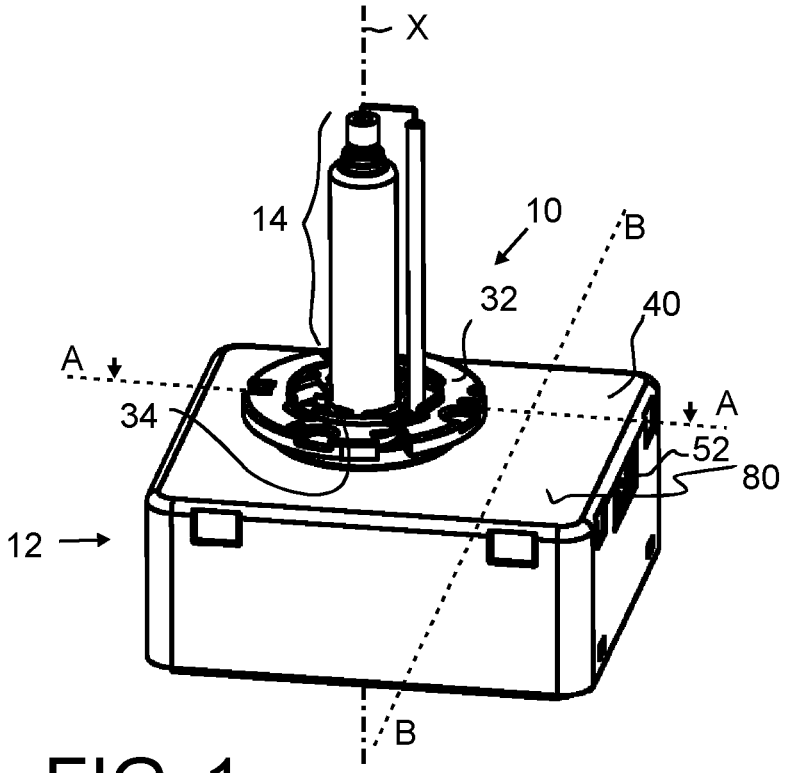
FIG. 1 shows a perspective view of an embodiment of an automotive HID lamp.

FIG. 1 shows a lamp 10 including a lamp base 12, from which a burner 14 protrudes.

Figure 2:
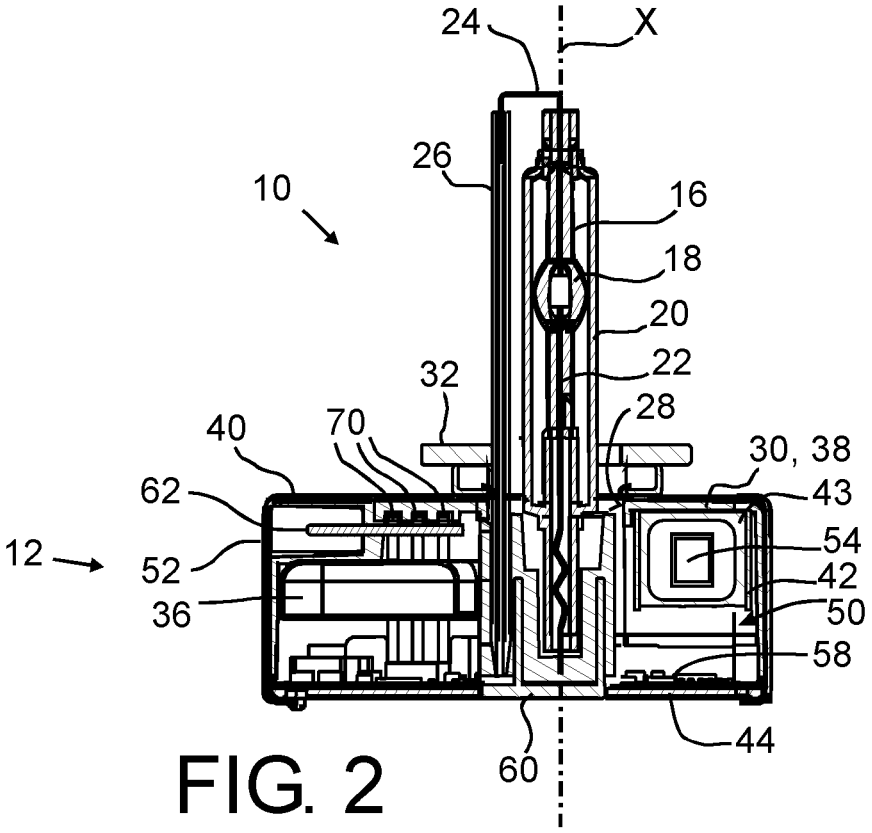
FIG. 2 shows a sectional view of the lamp of FIG. 1 with the section along A . . . A in FIG. 1.

As visible in particular from the cross-sectional view of FIG. 2, the burner 14 is comprised of a burner tube 16 forming a discharge vessel 18 with an enclosed discharge space and an outer bulb 20 arranged around the discharge vessel 18. The outer bulb 20 and the burner tube 16 with the discharge vessel 18 are made of quartz glass material. Within the discharge space, which comprises a filling of metal halides and Xenon, a first and second electrode are provided. The first electrode is electrically connected to a first, central contact lead 22 extending within the burner tube 16 into the housing 12. A second electrode is connected to a return contact lead 24 extending in parallel to the longitudinal axis X of the burner 14. A ceramic tube 26 is arranged around the return contact lead 24 for insulation.

The burner 14 is mechanically held relative to the lamp cap housing 12 by a holding ring structure 32 provided around the burner 14, fixed to a collar of the burner 14 by spot-welded spring tongues.

The lamp base 12 comprises a metal outer housing 40, an inner housing holder element 30, and a bottom plate 44. All of the outer housing wall elements 40, 44 are made out of aluminum as a metal material of good heat conduction properties. The inner holder element 30 is made out of a plastic material.

Within the lamp base 12, electrical components of a lamp operating circuit 50 are arranged. The lamp operating circuit 50 is supplied with electrical power from an electrical plug/socket connector 52 opening to the side of the lamp base 12. For use in a motor vehicle headlamp, the lamp 10 is electrically connected to onboard electrical power and to ground via the connector 52. The lamp operating circuit 50 integrated within the lamp base 12 provides all circuitry required to adapt the voltage supplied at connector 52 to the type of electrical driving voltage and current required for the operation of the burner 14 during ignition, following run-up and steady-state operation. The lamp operating circuit 50 comprises on a printed circuit board 58 and connected thereto circuitry and electrical components for ignition and operation of the lamp 10 as well as a microcontroller for controlling operation of to the burner 14.

Figure 3:
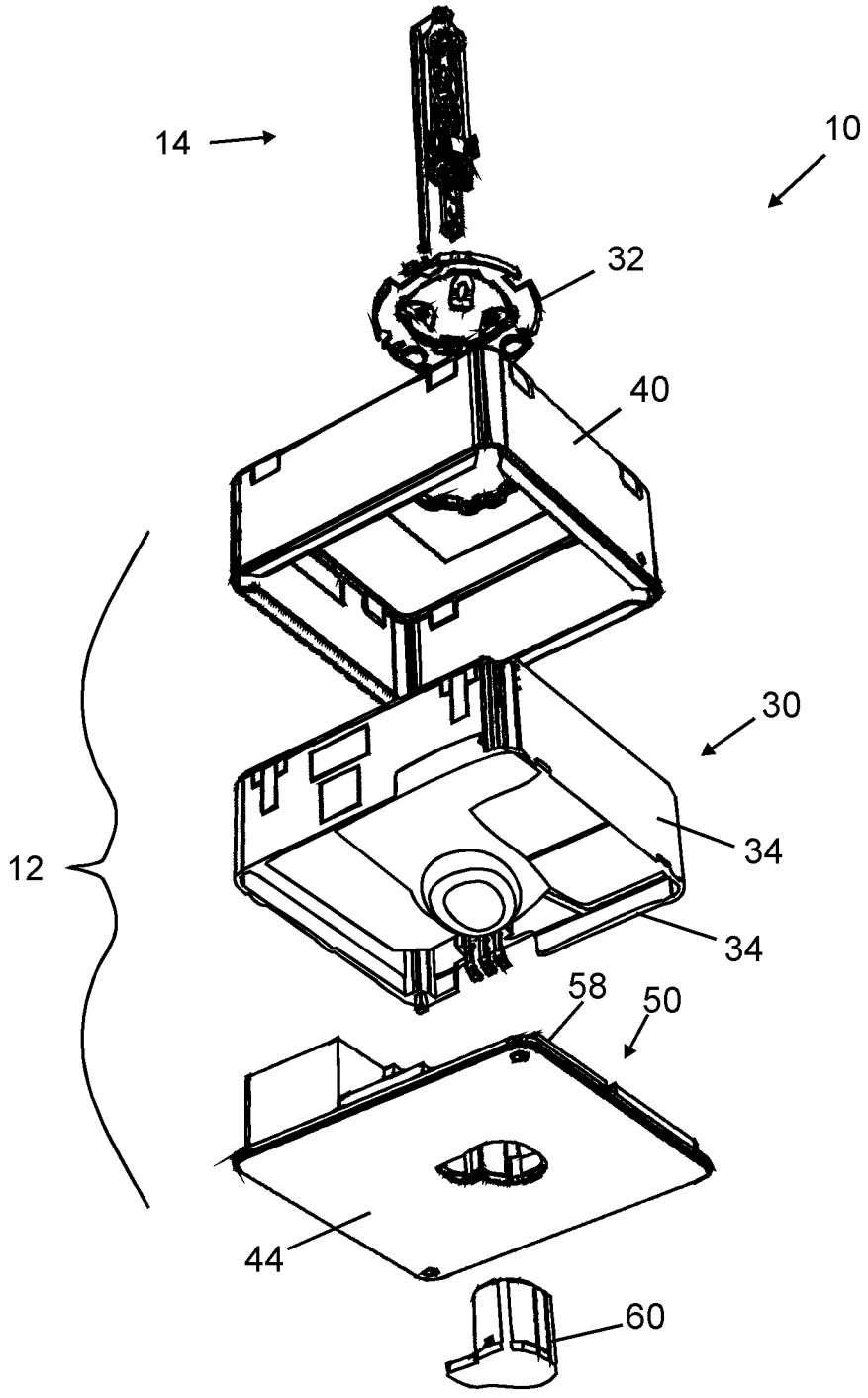
FIG. 3 shows an exploded view of the lamp of FIG. 1, FIG. 2.

As visible from the exploded view shown in FIG. 3 (where some internal parts within the base are not shown for better understanding), the plastic holder 30 is enclosed within the aluminum housing 40. As will be explained below, the holder 30 serves for mounting a plurality of components of the lamp operating circuit 50, such as a transformer and the electrical plug/socket connector 52. The holder 30 further holds electrical contacts of these components. The holder 30 is substantially box-shaped with side walls 34 and a top wall 38. The top wall 38, as shown in FIG. 2, is oriented towards the burner 14, covered by the metal housing 40.

As visible in particular from the cross-sectional view of FIG. 2, the burner 14 is mounted at a central opening 28, and is arranged to protrude quite a distance axially along the longitudinal axis X into the lamp base 12. The result of the corresponding arrangement of the burner 14 quite deep within the lamp base 12 leads to a reduced light center length (LCL), i.e. distance between the center of the discharge vessel 18 relative to the holding ring 32 comprising position reference elements for relative positioning within a reflector of a motor vehicle headlight unit.

As the burner 14 is thus installed to protrude into the lamp cap housing 12, the electrical contact leads from the burner 14, namely the central contact lead 22 and return contact lead 24, also extend into the lamp cap housing 12. In operation of the lamp 10, and in particular during ignition, insulation needs to be provided to prevent flashover between the electrical contact leads 22, 24 as well as from any of the contact leads 22, 24 to components or contact leads of the lamp operating circuit 50 or parts of the lamp cap housing 12. In order to provide this insulation, a plastic cap 60 is provided, covering the central contact lead 22 and the return contact lead 24 axially. The cap 60 serves to provide electrical insulation, in particular between the central contact lead 22 and return contact lead 24, but also between the contact leads 22, 24 and the metal bottom plate 44.

Components of the lamp operating circuit 50 are arranged on a printed circuit board 58 provided within the lamp base 12, holding and electrically interconnecting the electrical circuit components provided thereon. The printed circuit board (PCB) 58 with electrical components mounted on a top surface is arranged directly on the bottom plate 44. Thus, there is close thermal contact between the lamp operating circuit 50 and the bottom plate 44, so that the bottom plate 44 serves as heat sink.

The operating circuit 50 arranged within the base 12 comprises all necessary circuitry, such that the lamp 10 for all modes of operation requires only connection to the onboard voltage of a motor vehicle, which may be supplied at the plug/socket connector 52. The operating circuit 50 includes an ignitor for supplying a high voltage to the burner 14 for igniting an arc discharge within the discharge vessel 18. The operating circuit further comprises a driver circuit for generating an alternating current for operation of the burner 14 in a run-up period after ignition and in subsequent steady-state operation. The operating circuit 50 comprises a micro-controller for control of the operation of the components of operating circuit 50 and of the burner 14.

As shown in FIG. 7, the plug/socket connector 52 comprises three contacts 62 protruding within a socket cavity 64 formed within the holder element 30. One of the contacts 62 is a ground contact, connecting the lamp 10 to electrical ground of the vehicle onboard electrical system. The other contacts are provided for a supply voltage (onboard voltage of the vehicle, e.g. 12 V) and for transmitting communication control signals from an electronic control unit (ECU) on board of the vehicle to the micro-controller of the operating circuit 50 and vice versa.

FIG. 4-7 show how the electrical contacts 62 of the plug/socket connector 52 are connected to the PCB 58 via contact path elements 70, which are held by the holder 30.

Figure 4:
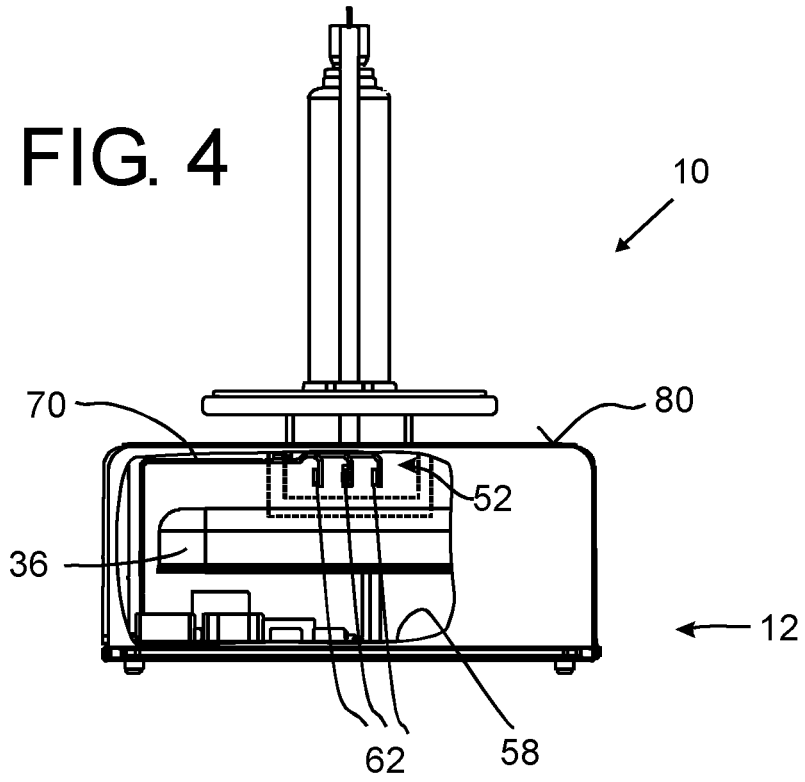
FIG. 4 shows a side view of the lamp of FIG. 1-3 with a partially cut-away housing.

The contact path elements 70 are flat, elongate metal strips or webs. Corresponding to the three contacts 62 of the plug/socket connector 52, there are three contact path elements 70 arranged in parallel within the base 12, extending from the connector 52 to the PCB 58. The contact path elements 70 are bent roughly L-shaped, as shown in FIG. 4 (where the holder 30 is not shown), FIG. 5. Both ends of the contact path elements 70 are bent to form contact flaps 71*a*, 71*b* for contacting the electrical contacts 62 of the connector 52 and for contacting contact surfaces of the PCB 58. Each contact flap 71*a* of the contact path element 70 is fixed to one plug contact 62 via spot welding, and each contact flap 71*b* is fixed to one contact surface 72 by soldering.

Figure 5:
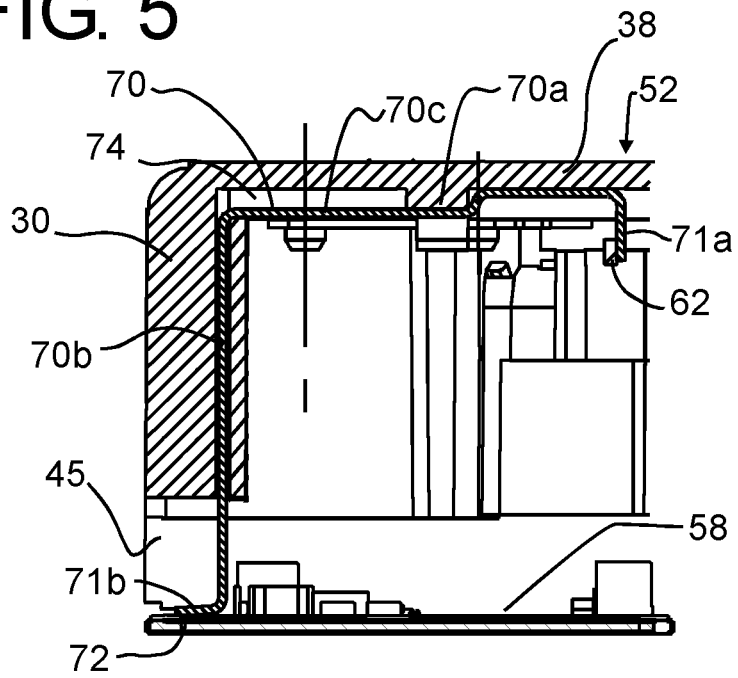
FIG. 5 shows an enlarged partial sectional view of the lamp of FIG. 1-4 with the section along B . . . B in FIG. 1.

As visible from FIG. 4, FIG. 5 (where the metal outer housing 40 is not shown), the contact path elements 70 extend from the connector 52 in a first portion 70*a* substantially in parallel to the upper surface of the base 12, oriented towards the burner (i.e. horizontally in FIG. 4, FIG. 5). The first portion 70*a* of the contact path elements 70 is fixed to the holder 30 by partly embedding the first portion 70*a* of the contact path elements 70 within the plastic material.

The contact path elements 70 are bent at an angle of about 90° to continue as a second section 70*b* towards the PCB 58, i.e. substantially in parallel to the longitudinal axis X of the lamp 10. The second section 70*b* of the contact path elements 70 is held and guided by the holder 30, but not fixed thereto. The holder 30 provides an elongate opening, through which the second section 70*b* of the contact path elements 70*a* protrudes, such that each of the metal webs is surrounded by the plastic material of the holder 30 in traverse directions. Thus, the second section 70*b* of the contact path elements 70 is slidably received within the opening of the holder 30, such that it is movable in longitudinal direction while being guided in traverse direction by the enclosing plastic material.

During assembly of the lamp 10, the assembled PCB 58 is connected to the holder 30 as shown in the exploded view of FIG. 3, such that the second contact flaps 71*b* of the contact path elements 70 come to rest on the contact surfaces 72 of the PCB 58.

In order to be able to establish a reliable solder connection, the holder 30 and the contact path elements 70 are pre-assembled with the length of the second section 70*b* designed for an interference fit, i.e. longer than necessary for an exact 90° bend between the first section 70*a* and second section 70*b* of the contact path elements 70. Thus, before assembly, the contact flaps 71*b* extend out of the holder 30 to protrude a small distance below. As the PCB 58 is fitted, a force acts longitudinally on the second section 70*b* of a contact path element 70, such that this section of the contact path elements 70 slides longitudinal within the guiding fit of the holder 30. Within the base 12, the holder 30 leaves a spring space 74 free, into which a third section 70*c* of the contact path elements is received as it is deflected by the force exerted on the second section 70*b* of the contact path elements 70.

By providing the mentioned oversize, slidable reception and spring space 74, a clamping fit of the contact flaps 71*b* on the contact surfaces 72 of the PCB 58 is achieved, where a spring force of the deflected third section 70*c* of the contact path elements 70 achieves a pressing force, pressing the contact flaps 71*b* onto the contact surfaces 72. Subsequently, the solder connection is made.

The holder 30 comprises an opening 45 which allows access to the contact flaps 71*b* and contact surfaces 72 for soldering.

As already mentioned, one of the contacts 62 provided at the connector 52 is an electrical ground contact, connected to electrical ground of the motor vehicle. As shown in FIGS. 6, 8, a contact spring 76 is provided in one piece with one of the contact path elements 70 serving as the electrical ground contact, the contact spring 76 being provided to establish an electrical ground connection to the metal housing 40.

The holder 30 includes an opening 78 provided within the top wall 38. The contact spring 76 is fixed to the holder 30 and extends through the opening 78 up to the metal housing 40.

As shown in the partial views of FIGS. 8, 9, the top surface 80 of the base 12 is a metal sheet element which is part of the metal housing 40 and is made from aluminum. A contact sheet element 82 is arranged flat underneath the top surface 80 of the metal housing 40 in close contact therewith. The contact sheet element 82 is a thin piece of sheet metal made from a steel material, considerably thinner than the aluminum sheet material of the top surface 80.

The burner holding ring 32 includes a flange 33 extending downwardly up to the top surface 80. The burner holding ring 32 is fixed to the base 12 by means of a crimping connection of the top surface 80 of the metal housing 40 with the flange 33. As shown in FIG. 9, the sandwich structure formed of the steel material of the contact sheet element 82 and the aluminum material of the top surface 80 of the metal housing 40 is bent at the central opening 28 for the burner 14 to surround the flange 33 of the burner holding ring 32. The thus formed crimping connection extends around the substantially circular opening 28 in the top surface 80 provided for the burner 14 and is effective to both fix the flange 33, and thereby the burner holding ring 32 to the top surface 80, and also to provide a close mechanical (and thereby also electrical) connection between the contact sheet element 82 and the top surface 80 of the metal housing 40.

As shown in FIG. 6, FIG. 8, the contact spring 76 provides two contact fingers 84 which bear against the lower surface of the contact sheet element 82 in a clamping fit. Thus, the electrical ground connection provided at the connector 52 is brought into electrical contact with the metal housing 40 via the contact spring 76 and the contact sheet element 82.

As already explained, the operating circuit 50 comprises an ignitor for igniting an electrical arc discharge within the discharge vessel 18. The ignitor includes an ignition transformer 54 as shown in FIG. 2, arranged within an insulation chamber 42 with side walls formed integrally with the holder 30. The ignition transformer 54 is embedded, for purposes of electrical insulation, within an insulation compound 43.

The insulation compound 43 is a silicone insulation compound, which is filled into the insulation chamber 42 in upside-down orientation, as e.g. shown in FIG. 6. The transformer 54 is placed within the insulation chamber 42, and the insulation compound 43 is filled into the chamber 42 in a liquid form. The holder 30 including the filled insulation chamber 42 is then placed into an oven for a heat curing treatment of the insulation compound 43, such that the insulation compound 43 solidifies.

During filling of the insulation chamber 42 in the upside-down orientation as shown in FIG. 6, any amounts of the liquid insulation compound 43 possibly leaking from the insulation chamber 42 into the interior of the holder 30 are retained by a retention wall 46 provided around the central opening 28. Thus, leaked amounts of the insulation compound 43 will not leak through the opening 28 onto the in the upside-down orientation of FIG. 6—bottom surface of the holder 30, i.e. onto the top surface (in FIG. 2) of the base 12, exposed to heat and radiation from the burner 14. Thus, evaporation of silicone, and in particular silicone entering the front parts of the lamp 10 and the reflector, into which the lamp 10 will be mounted, is effectively prevented.

The central opening 28 in the top wall 38 of the holder 30, through which the burner 14 protrudes, is connected with a further opening in the top wall 38, through which the return contact 24 enters the base 12. The retention wall 46 is arranged to surround both openings. Further, the top wall 38 of the holder 30 includes, as already explained, an opening 78 for the ground contact spring 76. The opening 78, as shown in FIG. 8, is also surrounded by raised retention walls 48, extending, in the same way as the retention wall 46 around the central opening 28, perpendicularly from the top wall 38 of the holder 30. Thus, even larger amounts of leaked insulation compound 43 are safely retained within the holder 30 until the curing treatment. During the curing treatment, leaked compound 43 within the interior of the holder 30 will solidify as well, such that there is no further risk of silicone entering the front portions of the lamp 10.

Figure 10:
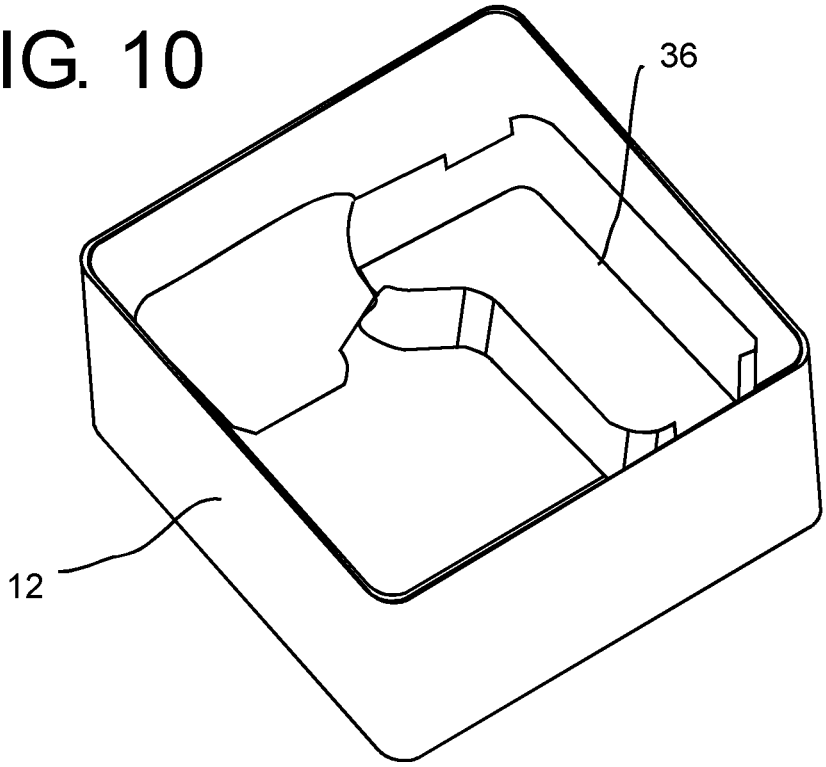
FIG. 10 shows a perspective view of parts of the lamp of FIG. 1-9, including an electromagnetic shield.

As shown in the figures, in particular FIG. 2, the packaging of electrical components and contacts within the base 12 is particularly dense, such that the distances between the electrical components are small. In order to reduce the risk of EMI, in particular from the ignitor components, such as the ignition transformer 54, a metal shield 36, as shown in FIG. 10, is arranged within the base 12. The metal shield 36 is arranged substantially in parallel to the top and bottom surfaces of the base 12, e.g. substantially horizontally, as shown e.g. in FIG. 2, FIG. 4. The metal shield 36 is arranged to partly cover the PCB 58, and in particular to separate components on the PCB 58 from the ignition transformer 54. Further, as shown in FIG. 2, the metal shield 36 is also arranged to partly shield the plug/socket connector 52 and the contact leads 70 from further components within the base 12, in order to prevent EMI from spreading within the base 12 via these connections.

While the invention has been illustrated and described in detail in the drawings and foregoing description, such illustration and description are to be considered illustrative or exemplary and not restrictive; the invention is not limited to the disclosed embodiments.

Variations of the disclosed embodiment can be understood and effected by those skilled in the art in practicing the claimed invention, from a study of the drawings, the disclosure and the appended claims. In the claims, the word "comprising" or "including" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Lamp comprising a burner fixed to a lamp base, where the lamp base comprises at least a metal housing part, said metal housing part comprising a contact sheet element made out of a metal material different from the material of said metal housing part, and where electrical contacts are provided within said base, said electrical contacts comprising an electrical ground contact, wherein a contact spring is provided for contacting said electrical ground contact to said metal housing part, where said contact spring is arranged to press against said contact sheet element to provide electrical ground connection to said metal housing part.

2. Lamp according to claim 1, where said contact sheet element and said metal housing part are flat elements provided with their surfaces on top of each other.

3. Lamp according to claim 1, where said contact sheet element said metal housing part are connected by a deformation of both, thereby mechanically locking said contact sheet element and said metal housing part.

4. Lamp according to claim 3, where said contact sheet element and said metal housing part are connected by a crimping or riveting connection.

5. Lamp according to claim 1, where said metal housing part comprises at least a top surface of said base oriented towards said burner, said burner comprising a burner holding element fixed to said metal housing part by a deformation of said metal housing part and of said contact sheet element.

6. Lamp according to claim 1, where a non-conductive holder element for holding electrical components and/or electrical connections of a lamp operating circuit is disposed within said base, where said contact spring is fixed to said non-conductive holder element.

7. Lamp according to claim 6, where said non-conductive holder element comprises an opening, and where said contact spring extends through said opening.

8. Lamp according to claim 1, where said lamp base comprises an electrical plug/socket connector comprising at least said electrical ground contact.

9. Lamp according to claim 1, where
said contact spring comprises at least two spring tongues pressing against said contact sheet element.

10. Lamp according to claim 1, where
said metal housing part is made of aluminum material.

11. Lamp according to claim 1, where
said contact sheet element is made out of steel material.

* * * * *